United States Patent [19]

Carroll et al.

[11] Patent Number: 4,586,292

[45] Date of Patent: May 6, 1986

[54] MACHINE IMPARTING COMPLEX ROTARY MOTION FOR LAPPING A SPHERICAL INNER DIAMETER

[75] Inventors: Thomas A. Carroll, Santa Fe; Harold H. Yetter, Los Alamos, both of N. Mex.

[73] Assignee: The United States of America as represented by the United States Department of Energy, Washington, D.C.

[21] Appl. No.: 696,550

[22] Filed: Jan. 30, 1985

[51] Int. Cl.[4] ..... B24B 31/00; B24B 11/00

[52] U.S. Cl. ..... 51/2 R; 51/227 R; 51/164.2; 366/219; 494/33

[58] Field of Search ..... 51/261, 227 R, 164.2, 51/1, 71, 2 R; 494/33; 366/219

[56] References Cited

U.S. PATENT DOCUMENTS

| | | | |
|---|---|---|---|
| 578,969 | 3/1897 | Coates | 51/2 R |
| 3,421,053 | 1/1969 | Rinard | 51/164.2 |
| 3,765,128 | 10/1973 | Surkey | 51/73 R |
| 3,925,936 | 12/1975 | Orlov | 51/118 |
| 4,033,075 | 7/1977 | Verbickas | 51/80 A |
| 4,206,573 | 1/1980 | Hayward | 366/219 |
| 4,361,987 | 12/1982 | Lapsker | 51/90 |
| 4,427,324 | 1/1984 | Franson | 409/12 |

*Primary Examiner*—Harold D. Whitehead

*Attorney, Agent, or Firm*—Joseph M. Hageman; Paul D. Gaetjens; Judson R. Hightower

[57] ABSTRACT

An apparatus for imparting complex rotary motion is used to lap an inner spherical diameter surface of a workpiece. A lapping tool consists of a dome and rod mounted along the dome's vertical axis. The workpiece containing the lapping tool is held in a gimbal which uses power derived from a secondary takeoff means to impart rotary motion about a horizontal axis. The gimbal is rotated about a vertical axis by a take means while mounted at a radially outward position on a rotating arm.

12 Claims, 3 Drawing Figures

MACHINE IMPARTING COMPLEX ROTARY MOTION FOR LAPPING A SPHERICAL INNER DIAMETER

This invention is the result of a contract with the Department of Energy (Contract No. W-7405-ENG-36).

BACKGROUND OF THE INVENTION

The present invention relates generally to an apparatus for imparting complex rotary motion, particularly for lapping a spherical inner diameter.

Lapping, or the final polishing, of a spherical inner surface has proven to be a difficult and time consuming procedure. A lapping tool composed of a dome grinding section with a rod attached along the central vertical axis of the dome has been used to lap a spherical inner diameter surface. However, to insure all sections of the inner diameter of the sphere are ground equally and that the space inside a workpiece is indeed a sphere, it has been necessary to rotate the workpiece and its holder in a complex pattern to prevent tracking. Tracking is when the lapping tool moves in something other than a random fashion that insures all the areas of the inner sphere surface are polished equally and are the same distance away from the center of the inner spherical volume.

Other machines used in an attempt to induce the sufficiently complex rotary motion to ensure a closer approach to a perfect spherical volume inside the workpiece included an arrangement where an arm pushed around the workpiece in a bowl. Another arrangement included a rotating bin with a floor that moved up and down. While the rotary motion provided to the workpiece was complex in both cases, the time required to lap one spherical surface was long and a substantial amount of noise was generated by the rotating bin with the moveable floor. Thus, a need still existed for an efficient, quick, and quiet method for imparting complex rotary motion for lapping a spherical inner diameter.

SUMMARY OF THE INVENTION

It is an object of the present invention to provide an apparatus for imparting complex rotary motion to a subject.

It is the further object of the present invention to provide an apparatus for lapping the spherical inner diameter of a workpiece.

It is yet another object of the present invention to provide an apparatus for imparting complex rotary motion wherein a subject is rotated around a horizontal axis at a ratio of 6.0 to 1.067 in relation to rotation around a vertical axis.

It is yet another object of the present invention to provide a spherical inner diameter lapping apparatus which laps the inner diameter of the sphere to a fine roundness in a quick and quiet manner.

Additional objects, advantageous and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects in accordance with the purpose of the present invention, as embodied and broadly described herein, the present invention may comprise an apparatus for imparting complex rotary motion to at least one subject comprising at least one holding means for the subject which rotates the subject around a horizontal axis; at least one means for rotating the holding means around a vertical axis; at least one rotating arm to which the rotating means is attached at a radially outward position, the rotating arm rotating about a vertical axis counter to the rotary motion of the rotating means; a power means to rotate the rotating arm; at least one takeoff means to derive power from the power means and induce rotary motion to the rotating means; and at least one secondary takeoff means to derive power from the takeoff means and transmit power to the holding means for inducing rotary motion to the subject.

The present invention may also comprise in accordance with its objects and purposes, a spherical inner diameter lapping apparatus comprising at least one lapping tool consisting of a grinding surface dome and a rod attached along the vertical axis of the dome, the lapping tool fitting within a workpiece; at least one shell for enclosing the workpiece; at least one holding means for the shell which rotates the shell around a horizontal axis; at least one measns for rotating the holding means around a vertical axis; at least one rotating arm to which the rotating means is attached at a radially outward position, the rotating arm rotating about a vertical axis counter to the rotary motion of the rotating means; a power means to rotate the rotating arm; at least one takeoff means to derive power from the power means and induce rotary motion to the rotating means; and at least one secondary takeoff means to derive power from the takeoff means and transmit power to the holding means for inducing rotary motion to the shell.

Preferably, the holding means and rotating means are combvined to form a gimbal.

An advantage of the present invention is derived from the complex nature of the rotary motion imparted to the shell enclosing the workpiece.

Another advantage of the present invention is that the various rotary motions can be geared in such a ratio that tracking of the lapping tool is prevented.

Still another advantage of the present invention is the reduced time necessary for achieving a close roundness of the inner sphere of a workpiece which saves energy and generates less noise than other lapping apparatus.

BRIEF DESCRIPTIN OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENT

Figure 1:
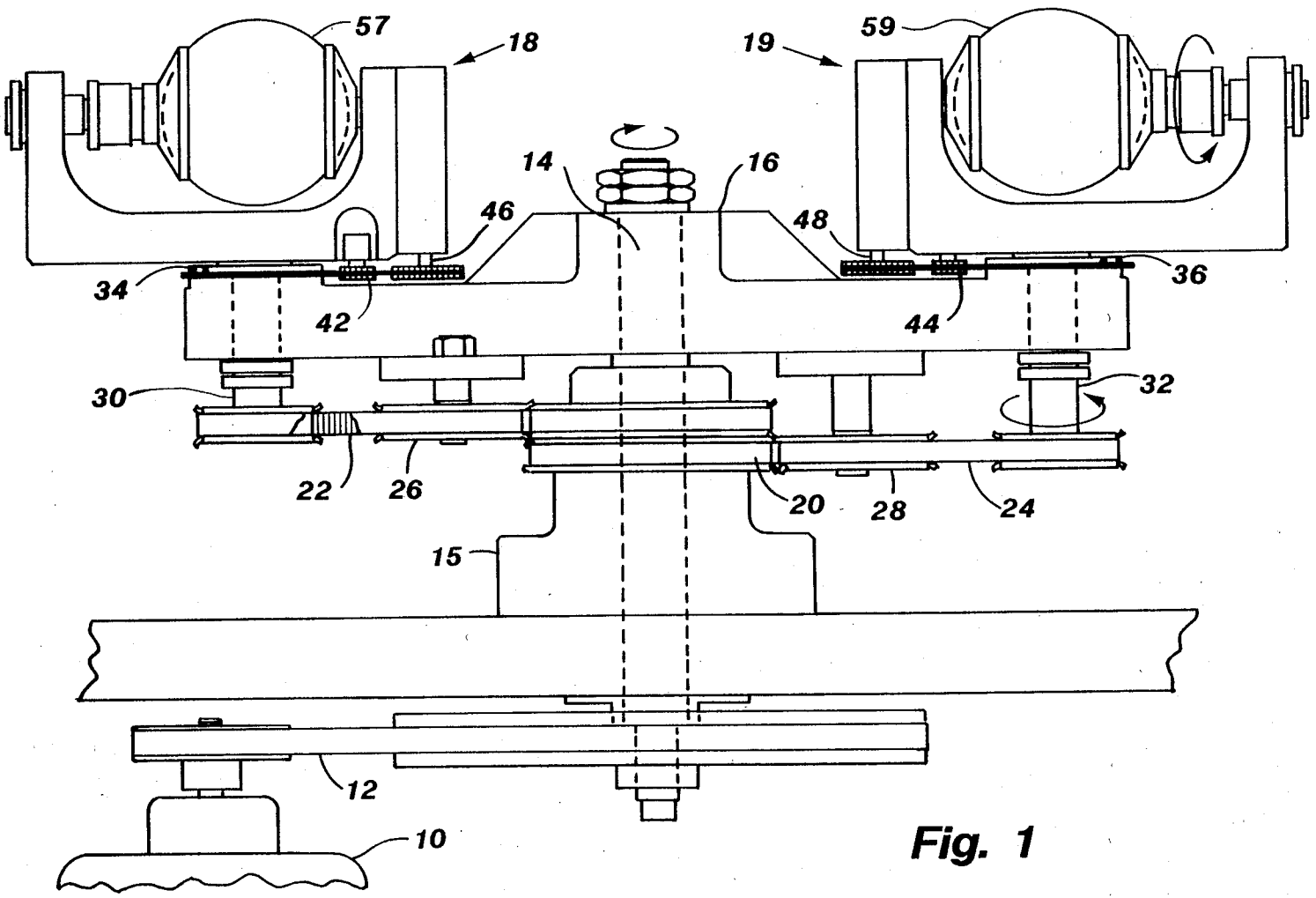
FIG. 1 is an elevation of the spherical inner diameter lapping apparatus.

Referring now to FIG. 1, at the bottom, is the top part of a motor 10 which provides power to rotate the apparatus. The motor can be powered by any means, but an electric motor is preferable because it can run at varying speeds. The power output of the motor can vary in accordance with the size of the apparatus and the workpieces to be lapped. A preferred motor is a Bodine dc motor, running on 110 volts and producing one quarter horsepower. The output spindle of the motor is used to rotate a belt 12 that transfers the power to a spindle 14, shown in hidden view inside spindle housing 15. Mounted on the spindle 14, again shown in hidden view, is the rotating arm 16. The rotating arm 16 should be balanced to provide smooth rotation. In the particular configuration of apparatus shown in FIG. 1 the rotating arm 16 is balanced by having a gimbal 18 located at the same radial distance from the spindle 14 as a matching gimbal 19. A different embodiment of the apparatus could be the direct attachment of the spindle 14 to the output shaft of the motor 10. Another alternative embodiment would be for the output of the motor 10 to end in a gear which is in direct contact with a gear mounted on the spindle 14. The belt transmission shown in FIG. 1 allows for some slippage between the motion of the motor 10 and the motion of the spindle 14, thus smoothing out any vibrations that arise either from the motor 10 or from the spindle 14 and rotating arm 16.

Mounted below the rotating arm 16 on spindle housing 156, in the embodiment shown in FIG. 1, is a central sprocket wheel 20 which is part of the takeoff means for providing power to induce rotary motion in the gimbals 18 and 19. A central sprocket wheel 20 provides two engagement grooves for a pair of timing belts 22 and 24 that are part of the takeoff means. Idling wheel 26 and 28 provide for the proper tension in the timing belts 22 and 24 to successfully engage the gimbal spindles 30 and 32 to receive power from the takeoff means. The timing belts 22 and 24 may either engage the cogged idling wheels 26 and 28 or run behind them in such a way that the smooth sides of the belts run on smooth wheels. The gimbal spindles 30 and 32 serve as a central axis for rotation of the gimbals 18 and 19 respectively. The gimbals 18 and 19 are therefore mounted in a fixed relationship with the gimbal spindles 30 and 32 and rotate therewith.

Below the gimbals 18 and 19 are the secondary takeoff means which are also a sprocket wheel and timing belt arrangement. Fixed on the gimbal spindles 30 and 32 are the secondary sprocket driver wheels 34 and 36 respectively. These sprocket driver wheels 34 and 36 have only one groove per wheel to engage a timing belt since secondary timing belts 38 and 40 are engaged with different sprocket driver wheels 34 and 36. Secondary idling wheels 42 and 44 maintain the proper tension in secondary timing belts 38 and 40 for their engagement with the bottom gears of worm shafts 46 and 48.

Figure 2:
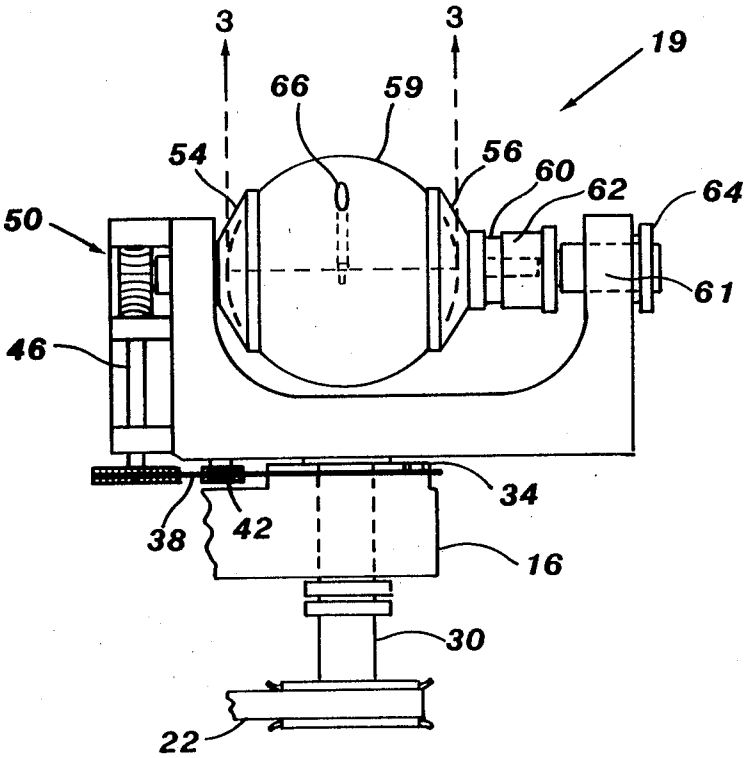
FIG. 2 is a close up of the holding means and rotating means.

Referring now to FIG. 2, one of the ends of the rotating arm 16 is shown. As in FIG. 1, timing belt 24 is engaged with gimbal spindle 32. Shown below gimbal 19, is the secondary takeoff means including a secondary timing belt 40, secondary idling wheel 44 and worm shaft 48 with the bottom consisting of a gear wheel for engaging the secondary timing belt 40. The top of worm shaft 48 ends in a set of gears 50 that translates the rotation of the worm shaft 48 into a rotary motion for the holding means. The rotary motion is taken from the secondary takeoff means by a shaft 52 which ends in an engaging cup 54. Opposed to the engaging cup 54 is a moveable engaging cup 56 which can be spaced an appropriate distance away from the first engaging cup 54 to firmly secure a shell 59 for holding a workpiece shown in FIG. 3. The moveable engaging cup 56 is mounted at the end of a rotating shaft 60. The rotating shaft 60 is engaged as the inner race of a thrust bearing 62. A moveable shaft 61 is threadably engaged through the side wall of gimbal 19 and ends as the outer race of thrust bearing 62. Also shown in locking ring 64 which freezes the position of moveable shaft 61 when a desired space has been created between engaging cup 54 and moveable engaging cup 56. FIG. 2 shows the plane of cross section of the shell 59 that is displayed in FIG. 3.

Figure 3:
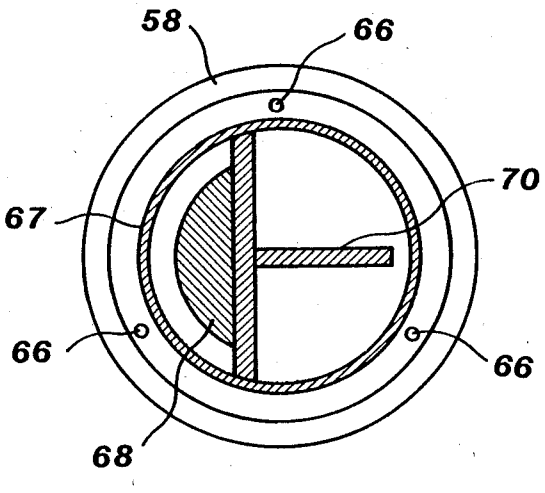
FIG. 3 is a cross section of the shell which holds a spherical workpiece containing a grinding surface dome and a rod.

Referring now to FIG. 3, a cross section of shell 59, the outermost ring of material is an engaging lip 58 of the shell 59. Spaced near the engaging lip 58 are three screw holes for fastening the two hemispherical pieces of shell 59 together. Generally, one hemispherical piece of shell 59 has a male lip 58 and the other hemispherical piece of shell 59 has a female (i.e. recessed groove) lip 58. Within the spherical inner diameter of workpiece 67 is the lapping tool. The lapping tool consists of a grinding surface dome 68 and a rod 70, used to prevent tumbling of the lapping tool during rotary motion. The lapping tool in FIG. 3 is shown in an artificial position to enable the cross section of the lapping tool to be displayed. Each lapping tool is custom fit to the desired specifications of the spherical inner diameter. Preferably the grinding surface actually in contact with the inner sphere of the workpiece 67 to be machined is a tapered ring at the widest part of the dome 68. Generally, the dome 68 at its widest part is 85 percent of the spherical diameter which tapers down to 70 percent of the spherical diameter at the point on the dome 68 where contact ceases with the inner diameter surface to be machined. The top of the dome 68 is then tapered more drastically to prevent contact with the inner diameter surface. The rod 70 is preferably of phenolic composition. The grinding surface of the dome 68 is usually cast iron, steel or brass, weighted with lead, to provide a center of gravity near the peak of the dome 68.

After a lapping tool of proper dimensions has been made, the lapping tool is placed in the inner diameter sphere of the workpiece 67 to be lapped. Also, oil and diamond or other abrasive compound is added to the inner cavity of the workpiece 67 to provide for more efficient lapping. The workpiece 67 is then placed between the two hemispherical pieces of shell 59 and then the pieces of shell 59 are fixed together with screws. The shell 59 is then placed between engaging cup 54 and moveable engaging cup 56 and the moveable shaft 61 is adjusted in position to push moveable engaging cups 56 close enough to engaging cup 54 to hold the shell 59 containing the workpiece 67 in gimbal 19. Locking ring 64 is tightened to prevent slippage of moveable shaft 61 which would release of shell 59 from gimbal 19. To provide for a balanced motion, another workpiece and shell 57 combination is placed into gimbal 18, in the particular apparatus shown in FIG. 1. Of course, only one shell and workpiece combination may be machined at a time if a different apparatus only has space for one such work assembly and is balanced by other means.

Motor 10 is then started in motion. The motor 10 may, if equipped with variable speed controls, be slowly started and gradually the speed of rotation increased. The spindle 14 is set in motion which engages rotating arm 16 in motion. The motion of rotating arm 16 may be in any gear relationship with motor 10 that is dictated by the need for efficient running of the motor 10. When the motion of rotating arm 16 begins, the takeoff means and secondary takeoff means begin in motion also. Preferably, the takeoff means is geared such that for every rotation of the rotating arm 16, the gimbals 18 and 19 are rotated twice. A secondary takeoff means is preferably geared such that for every thirty-two turns of the gimbal spindles 30 and 32, the worm shafts 46 and 48 are rotated sixty times. The shells 57 or 59 are turned once for every thirty turns of the worm shafts 46 or 48. The result is that for every sixty turns of gimbal spindles 30 or 32, 1.06 rotations are made by the shells 57 or 59. This ratio has been found to be effective in preventing the lapping tool from tracking, i.e., to prevent the lapping tool from repeating the same paths across the inner diameter surface of the workpiece 67.

As shown in FIG. 1 the motion of rotating arm 16 as induced by motor 10 is, as seen from above, arbitrarily shown to be clockwise. The motion of the gimbals 18 and 19 is therefore counterclockwise. The motion of the shell 59 is arbitrarily shown to be counterclockwise as seen from the worm shaft 48 looking toward the shell 59. The only requirement ruling these arbitrary choices is that the motion of the rotating arm 16 be opposite to the motion of the gimbals 18 and 19.

The spherical inner diameter lapping apparatus described above has reducing machining times for achieving roundness to within ten one-millionths of an inch from forty or more hours, and for particularly hard to machine surfaces up to two weeks, to less than thirteen hours. Such reduction in machining time and power required dramatically reduces the energy consumed. The main spindle 14 is rotated at 150 rpm up to 400 rpm. The actual lapping compound can be either aluminum oxide, silicon carbide or a diamond lapping abrasive. The apparatus as shown in FIG. 1 should be surrounded by some type of guard enclosure for the safety of operating personnel. The guard may contain holes to allow air in to carry off the heat generated by the rotating machinery. More commonly, the floor of the guard enclosure contains holes to allow air in to carry off heat.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical applicatiion to thereby enable others skilled in the art to best utilize the invention in various embodiments and with various modifications as are suited to the particular use contemplated. It is intended that the scope of the invention be defined by the claims appended hereto.

What is claimed:

1. An apparatus for imparting complex rotatary motion to at least one subject comprising:

at least one holding means for said subject which rotates said subject around a horizontal axis;

at least one means for rotating said holding means around a vertical axis;

at least one rotating arm to which said rotating means is attached at a radially outward position, said rotating arm rotating about a vertical axis counter to the rotary motion of said rotating means;

a power means to rotate said rotating arm;

at least one takeoff means to derive power from power means and induce rotary motion to said rotating means; and at least one secondary takeoff means to derive power from takeoff means and transmit power to said holding means for inducing rotary motion to said subject.

2. The complex rotary motion apparatus of claim 1 wherein said takeoff means consists of a timing belt and sprocket wheels.

3. The complex rotary motion apparatus of claim 1 wherein said secondary takeoff means consists of a timing belt and sprocket wheel conncted to the rotating means and to a worm gear assembly which induces said holding means to rotate said subject.

4. The complex rotary motion apparatus of claim 1 wherein said takeoff means is geared to provide said rotating means with motion at a 2 to 1 ratio with the movement of said rotating arm and said secondary takeoff means is geared to provide said subject with motion at a 60 to 1.067 ratio with the movement of said rotating mean.

5. The complex rotary motion apparatus of claim 1 wherein said holding means and rotating means are combined to form a gimbal.

6. The complex rotary motion apparatus of claim 1 wherein said rotating arm has radially opposite matching rotating means, holding means, takeoff means and secondary takeoff means.

7. A spherical inner diameter lapping apparatus comprising:

at least one lapping tool consisting of a grinding surface dome and a rod attached along the vertical axis of the dome, said lapping tool fitting within at least one workpiece;

at least one shell for enclosing said workpiece;

at least one holding means for said shell which rotates said shell around a horizontal axis;

at least one means for rotating said holding means around a vertical axis;

at least one rotating arm to which said rotating means is attached at a radially outward position, said rotating arm rotating about a vertical axis counter to the rotary motion of said rotating means;

a power means to rotate said rotating arm;

at least one takeoff means to derive power from power means and induce rotary motion to said rotating means; and at least one secondary takeoff means to derive power from takeoff means and transmit power to said holding means for inducing rotary motion to said shell.

8. The complex rotary motion apparatus of claim 7 wherein said takeoff means consists of a timing belt and sprocket wheels.

9. The complex rotary motion apparatus of claim 7 wherein said secondary takeoff means consists of a timing belt and sprocket wheel connected to the rotating means and to a worm gear assembly which induces said holding means to rotate said subject.

10. The complex rotary motion apparatus of claim 7 wherein said takeoff means is geared to provide said rotating means with motion at a 2 to 1 ratio with the movement of said rotating arm and said second takeoff means is geared to provide said subject with motion at a 60 to 1.067 ratio with the movement of said rotating means.

11. The complex rotary motion apparatus of claim 7 wherein said holding means and rotating means are combined to form a gimbal.

12. The complex rotary motion apparatus of claim 7 wherein said rotating arm has radially opposite matching rotating means, holding means, takeoff means and secondary takeoff means.

* * * * *